US008510950B2

(12) United States Patent
Hsieh

(10) Patent No.: US 8,510,950 B2
(45) Date of Patent: Aug. 20, 2013

(54) METHOD FOR MAKING A BICYCLE HUB

(75) Inventor: Kin-Ho Hsieh, Taichung Hsien (TW)

(73) Assignee: Bitex Industrial Co., Ltd., Taichung Hsien (TW)

( * ) Notice: Subject to any disclaimer, the term of this patent is extended or adjusted under 35 U.S.C. 154(b) by 193 days.

(21) Appl. No.: 13/195,016

(22) Filed: Aug. 1, 2011

(65) Prior Publication Data

US 2011/0283538 A1 Nov. 24, 2011

Related U.S. Application Data

(63) Continuation-in-part of application No. 12/019,881, filed on Jan. 25, 2008, now abandoned.

(51) Int. Cl.

| | |
|---|---|
| ***B21D 5/00*** | (2006.01) |
| ***B21K 1/40*** | (2006.01) |
| ***B60B 27/00*** | (2006.01) |

(52) U.S. Cl.

USPC ..... 29/894.362; 29/894.36; 72/369; 72/370.11; 301/110.5

(58) Field of Classification Search

USPC ..... 29/894.362, 894.36; 72/369, 370.11; 301/110.5

See application file for complete search history.

(56) References Cited

U.S. PATENT DOCUMENTS

| | | | | |
|---|---|---|---|---|
| 412,389 | A * | 10/1889 | Isherwood | 72/370.03 |
| 504,888 | A * | 9/1893 | McLish et al. | 301/110.5 |
| 1,754,922 | A * | 4/1930 | Weldon | 29/894.362 |
| 1,928,911 | A * | 10/1933 | Riemenschneider et al. | 29/894.362 |
| 4,998,344 | A * | 3/1991 | Hsieh | 29/894.362 |
| 2007/0084056 | A1 * | 4/2007 | Hsieh | 29/894.362 |
| 2008/0110023 | A1 * | 5/2008 | Hsieh | 29/894.362 |

* cited by examiner

*Primary Examiner* — Alexander P Taousakis
(74) *Attorney, Agent, or Firm* — Banger Shia

(57) ABSTRACT

A method of making a rear hub of a bicycle comprises: swaging a straight pipe into an hour-glass-shaped semi product, extruding the semi-product to form a hub flange, punching a plurality of holes in the hub flange of the semi-product, binding an edge of an end of the semi-product, necking down the edge-bound end of the semi-product, trimming the semi-product, and chamfering the holes of the semi-product to form a chamfer structure on an edge of the respective holes.

1 Claim, 5 Drawing Sheets

METHOD FOR MAKING A BICYCLE HUB

This application is a continuation in part of U.S. patent application Ser. No. 12/019,881 filed Jan. 25, 2008 now abandoned.

BACKGROUND OF THE INVENTION

1. Field of the Invention

The present invention relates to a method of making a component of a bicycle, and more particularly to a method of making the rear hubs of a bicycle.

2. Description of the Prior Art

Hub is an important component disposed in the center of a wheel of a bicycle, and the hub is generally in the form of a hollow pipe that is formed at either end thereof with a circular hub flange, and in the hub flange are annularly formed a plurality of through holes for insertion of spokes.

U.S. Pat. No. 4,998,344 discloses a method for manufacturing a hub, which comprises the following steps: rotary swaging a section of a tube into a rough shape of a hub; cutting the swaged portion from the tube; and squeezing both ends of the swaged portion by a right mold and a left mold so as to form a hub. However, this method of manufacturing a hub still has the following shortcomings that need to be improved:

Firstly, the length of the resultant hub usually exceeds the maximum tolerance because of the factors of the molding tolerance and the length tolerance of the work piece.

Secondly, during the swaging process, the radial dimension of the hub often deviates from the preset value. If the hole of the hub is too large, then the axle cannot be firmly positioned in the hub, and if the hole of the hub is too small, it will be difficult to assemble the axle into the hub.

Thirdly, the after-swaging hub must be trimmed prior to squeezing process due to the length of the resultant hub usually exceeds the maximum tolerance as mentioned above, and the hub after squeezing should also be subjected to a trimming process for the same reason.

Fourthly, the hub after squeezing is still not a finished product because it has to be subjected to chamfering, punching, etc, otherwise spokes and shaft cannot be assembled.

Other methods for making bicycle hub, such as disclosed in U.S. Pat. Nos. 1,754,922, 1,928,911, also have the same disadvantages as mentioned above, namely, after each step is done and prior to the next step is performed, it requires an extra trimming process to trim the work piece, so the steps are not performed consecutively, which adversely affects the production efficiency.

The present invention has arisen to mitigate and/or obviate the afore-described disadvantages.

SUMMARY OF THE INVENTION

The primary object of the present invention is to provide a method of making a rear hub of a bicycle, and the method comprises the steps of swaging, extruding, punching, edge binding, necking and trimming and chamfering. The above steps are made consecutively. The swaging, extruding, punching and edge binding are all consecutively without requiring any extra trimming process to be performed to trim the work piece after each step is done and prior to the next step. After the five steps, a compact final product of a rear hub is obtained with using extra trimming process, and only one round of trimming is required throughout the whole manufacturing process of the rear hub.

A method for making a rear hub of a bicycle in accordance with the present invention comprises the following steps:

swaging a straight pipe with a mold into an hour-glass-shaped semi product;

extruding the semi-product with a mold to form a hub flange at either end of the semi-product;

punching a plurality of holes in the hub flange of the semi-product, and the holes are annularly arranged;

binding an edge of an end of the semi-product to make the end of the semi-product expand outwards, forming a flared end;

necking down the flared end of the semi-product to make this end constant in diameter;

trimming both ends of the semi-product to a predetermined value; and chamfering the holes of the semi-product to form a chamfer structure on an edge of the respective holes.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
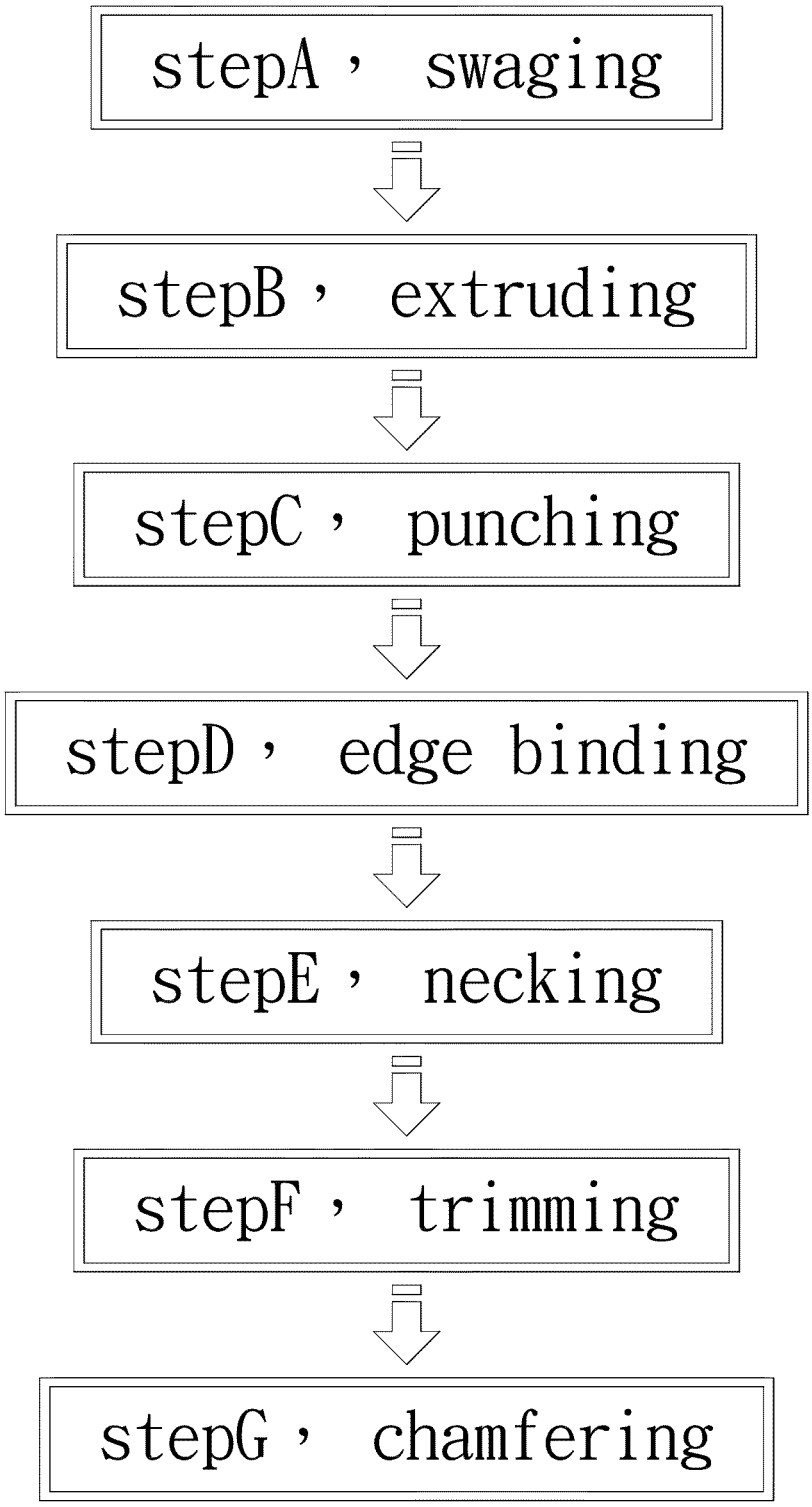
FIG. 1 is a flow chart in accordance with the present invention of showing the steps of making the rear hub of a bicycle.
Figure 2:
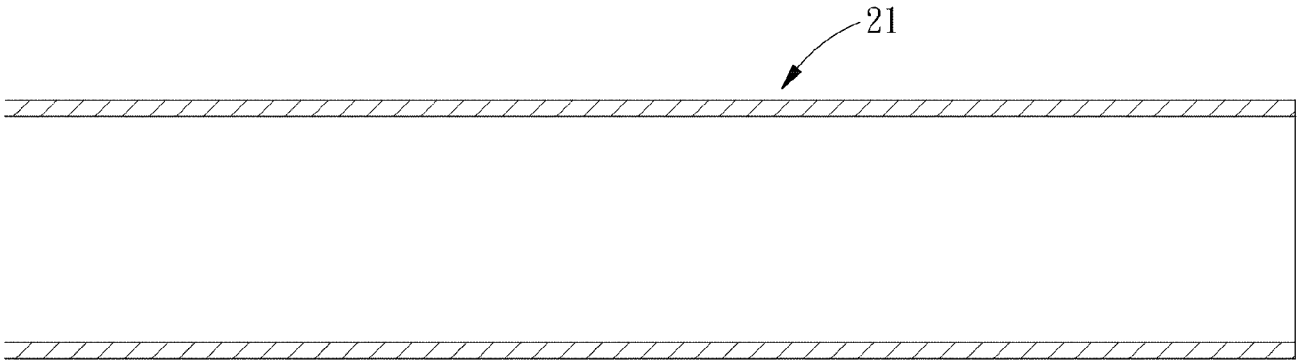
FIG. 2 is an illustrative view of showing a straight pipe.
Figure 3:
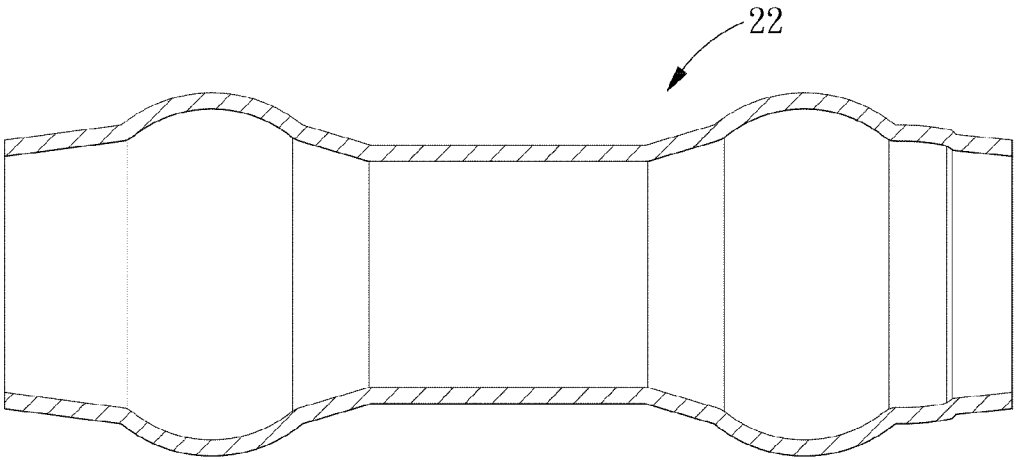
FIG. 3 shows that the straight pipe has been swaged into a semi-product.

Referring to FIGS. 1-9, a method of manufacturing a rear hub of a bicycle in accordance with the present invention is shown and comprises the following steps:

A, swaging: placing a straight pipe 21 (work piece) into a mold and swaging it into an hour-glass-shaped semi product 22, as shown in FIGS. 2-3.

Figure 4:
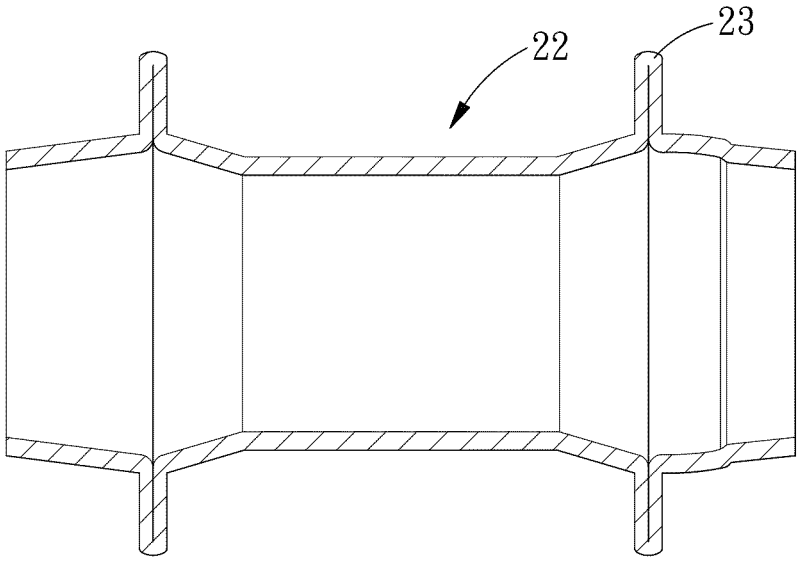
FIG. 4 shows the semi-product after it is extruded.

B, Extruding: extruding the semi-product 22 with a mold to form a hub flange 23 at either end of the semi-product 22, as shown in FIG. 4.

Figure 5:
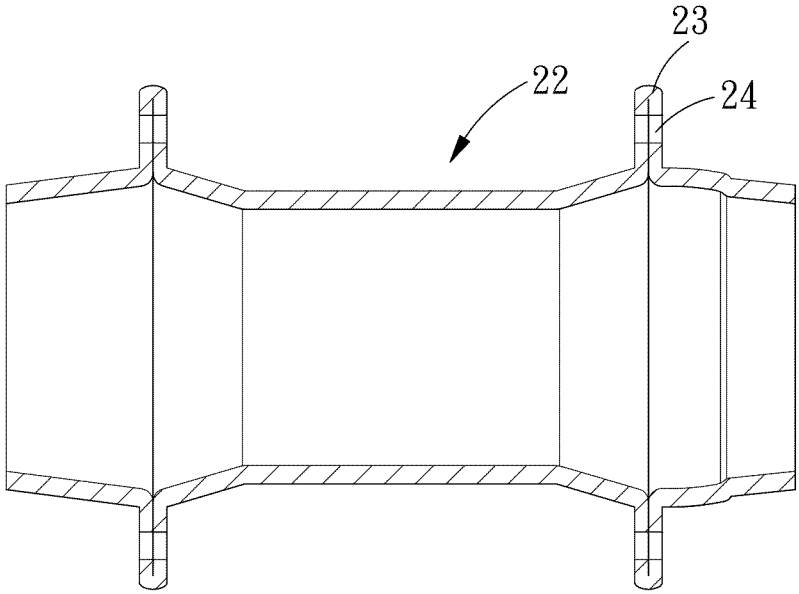
FIG. 5 shows the semi-product after it is punched.

C, Punching: punching a plurality of holes 24 in the hub flange 23 of the semi-product 22, as shown in FIG. 12, wherein the holes 24 are annularly arranged, as shown in FIG. 5.

Figure 6:
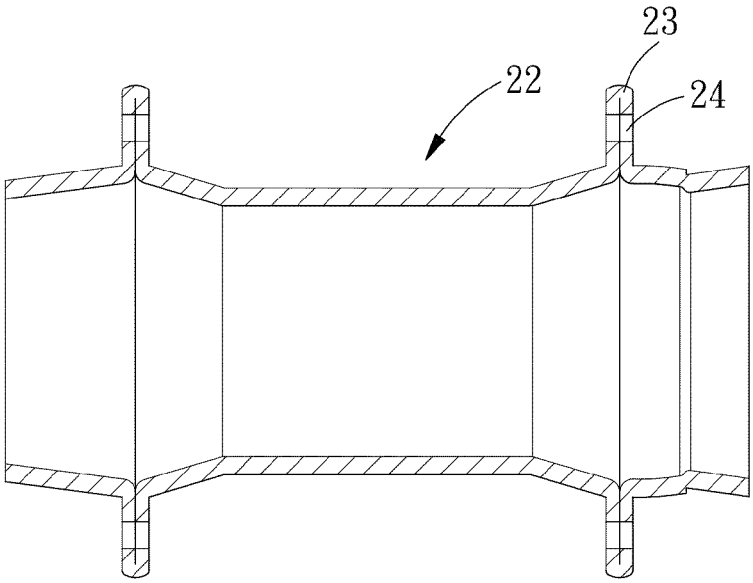
FIG. 6 shows the semi-product after its edge has been bound.

D, binding: binding the edge of an end of the semi-product 22 to make the end of the semi-product 22 expand outwards, forming a flared end (as shown in FIG. 6).

Figure 7:
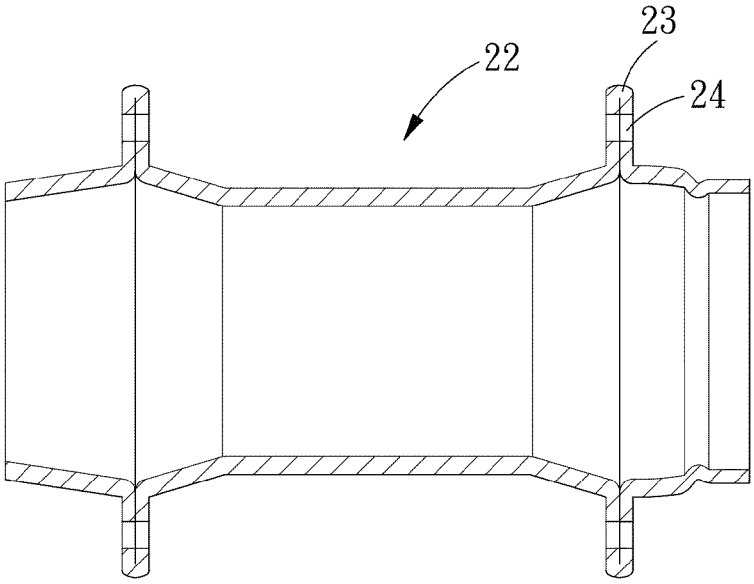
FIG. 7 shows the semi-product after its end has been necked down.

E, necking down the flared end of the semi-product 22 to make the end constant in diameter, as shown in FIG. 7, for facilitating assembly of axial tube, bearing, ball race and etc.

Figure 8:
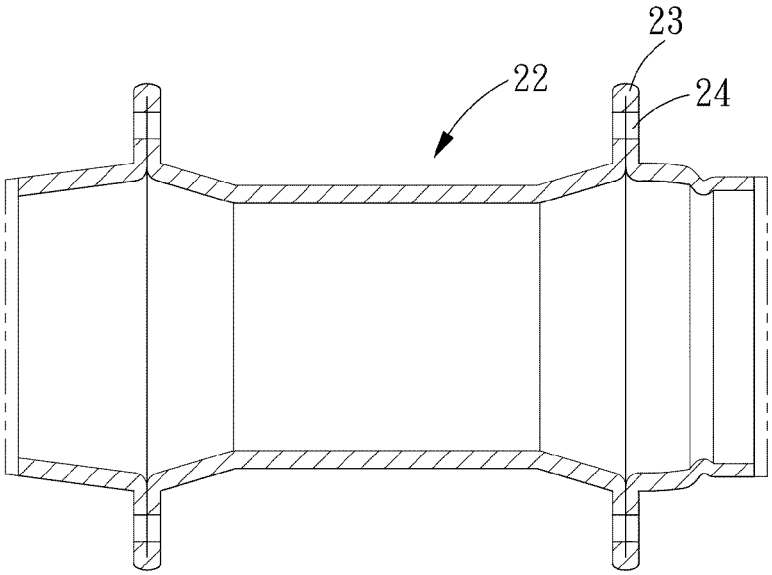
FIG. 8 shows the semi-product after it is trimmed.

F, Trimming: trimming both ends of the semi-product 22, as shown in FIG. 8.

Figure 9:
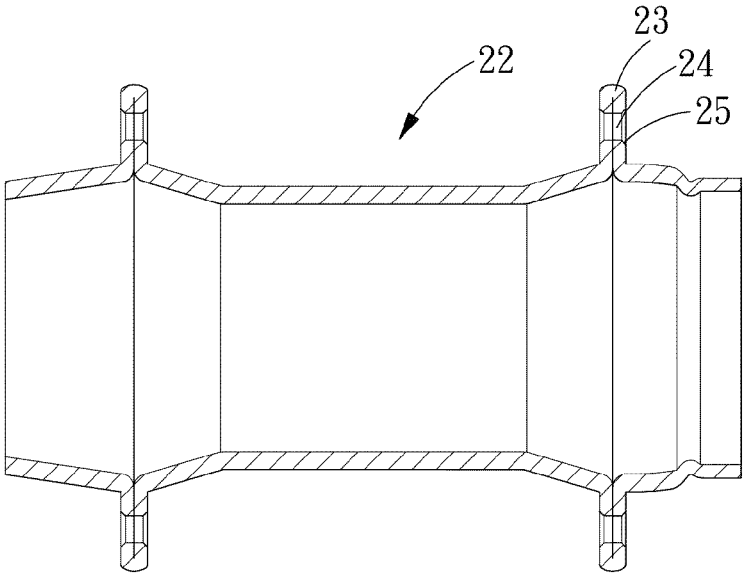
FIG. 9 shows the resultant product after being chamfered.

G, Chamfering; chamfering the holes 24 of the semi-product 22 to form a chamfer structure 25 on the edge of the holes 24, as shown in FIG. 9, for quick and easy assembly of the spokes.

Edge binding process not only can make the size of the edge of the end of the semi-product 22 more compact and precise, but also can improve the semi-product's strength.

While we have shown and described various embodiments in accordance with the present invention, it should be clear to those skilled in the art that further embodiments may be made without departing from the scope of the present invention.

What is claimed is:

1. A method for making a rear hub of a bicycle comprising the following steps:

swaging a straight pipe with a mold into an hour-glass-shaped semi product;

after swaging, extruding the semi-product with a mold to form a hub flange at either end of the semi-product;

after extruding, punching a plurality of holes in the hub flange of the semi-product, and the holes are annularly arranged;

after punching, binding an edge of an end of the semi-product to make the end of the semi-product expand outwards, forming a flared end;

after binding, necking down the flared end of the semi-product to make this end constant in diameter;

after necking, trimming both ends of the semi-product to a predetermined value; and after trimming, chamfering the holes of the semi-product to form a chamfer structure on an edge of the respective holes.

* * * * *